US005133178A

United States Patent [19]

Buchert et al.

[11] Patent Number: 5,133,178

[45] Date of Patent: Jul. 28, 1992

[54] POLYETHER KETONE SEWING YARN

[75] Inventors: Hermann Buchert, Bad Durkheim; Rainer Neuberg, Dannstadt-Schauernheim; Hans G. Matthies, Ludwigshafen; Karl-Heinz Butzheinen, Augsburg, all of Fed. Rep. of Germany

[73] Assignee: BASF Aktiengesellschaft, Ludwigshafen, Fed. Rep. of Germany

[21] Appl. No.: 501,790

[22] Filed: Mar. 28, 1990

[30] Foreign Application Priority Data

Mar. 30, 1989 [DE] Fed. Rep. of Germany ..... 3910258

[51] Int. Cl.[5] ..... D02G 3/02; D02G 3/36; D02G 3/00

[52] U.S. Cl. ..... 57/241; 428/364; 428/373

[58] Field of Search ..... 57/236, 238, 243, 239–242, 57/244–247, 251; 428/364, 373

[56] References Cited

U.S. PATENT DOCUMENTS

| | | | |
|---|---|---|---|
| 3,582,418 | 6/1971 | Schuur | 428/373 X |
| 3,969,885 | 7/1976 | Anahara et al. | 57/243 X |
| 4,054,025 | 10/1977 | Kubitzek et al. | 57/243 |
| 4,300,343 | 11/1981 | Nakamura et al. | 428/364 X |
| 4,350,006 | 9/1982 | Okamoto et al. | 57/243 X |
| 4,528,223 | 7/1985 | Kumazawa et al. | 57/238 X |
| 4,586,708 | 5/1986 | Smith et al. | 428/373 X |
| 4,610,905 | 9/1986 | von Blücher et al. | 428/373 X |
| 4,933,130 | 6/1990 | Bruckner et al. | 264/129 |

FOREIGN PATENT DOCUMENTS

| | | | |
|---|---|---|---|
| 0202082 | 11/1986 | . | |
| 511305 | 8/1971 | Switzerland | 428/364 |

*Primary Examiner*—Daniel P. Stodola
*Assistant Examiner*—Michael R. Mansen
*Attorney, Agent, or Firm*—Oblon, Spivak, McClelland, Maier & Neustadt

[57] ABSTRACT

A polyether ketone sewing yarn comprises a multifilament yarn having an individual filament linear density of from 1.0 to 10 dtex, an elongation at break of from 3 to 30% and a boil shrinkage of less than 10%.

18 Claims, 1 Drawing Sheet

POLYETHER KETONE SEWING YARN

BACKGROUND OF THE INVENTION

1. Field of the Invention

The present invention relates to sewing yarn comprising at least one multifilament yarn whose mutually twisted-together individual filaments are made of a thermoplastic polymer.

2. Discussion of the Background

Sewing yarns for industrial materials, such as tarpaulins, seat covers and glass fabrics, but also for leather and plastics are customarily based on polyesters.

However, such sewing yarns have the disadvantage of a comparatively low melting point, so that they can only be processed on high-speed sewing machines, in particular automatic sewing machines where abrupt change in the sewing speed can make the sewing yarns very hot, if they have been provided with a special finish. In addition, polyester fibers are not sufficiently hydrolysis- and solvent-resistant for many purposes.

A higher temperature resistance is one of the properties of sewing yarns made of aromatic polyamide (Kevlar®). However, they are expensive to produce; moreover, their mechanical properties are fixed by the process of manufacture (solvent spinning), so that they can only be varied within narrow limits and cannot be adapted to changing requirements. Furthermore, they are very difficult to dye. Such sewing yarns have therefore not become important in the field.

It is known that polyether ketones can be spun from the melt into fibers and then be drawn. A suitable spinning process is described for example in EP-A-202 082. The resulting multifilament yarns have a wide range of properties. For instance, the linear density of the individual filament can range from 2.8 to 100 denier (corresponding to 2.5 to 90 dtex), and the elongation at break can be 15–200%. However, it is not stated that such fibers can be used to produce sewing yarns and which multifilament yarns are particularly suitable for that purpose.

SUMMARY OF THE INVENTION

It is an object of the present invention to develop thermoplastic-based sewing yarns of similar tensile strength, elongation at break and dye ability to polyester which, in addition, are hydrolysis- and solvent-resistant and permit high sewing speeds, even on modern automatic sewing machines.

DETAILED DESCRIPTION OF THE PREFERRED EMBODIMENTS

Figure 1:
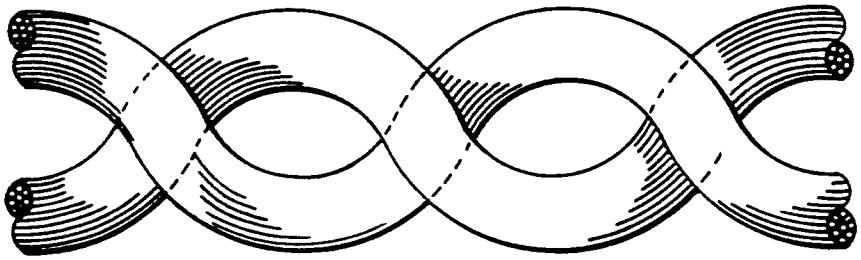
FIG. 1 illustrates a two-fold yarn having a multitude of filaments according to the present invention.

We have found that this object is achieved when the thermoplastic polymer is a polyether ketone and the multifilament yarn has an individual filament linear density (as defined in German Standard Specification DIN 53 830) of from 1.0 to 10 dtex, an elongation at break (as defined in German Standard Specification DIN 53 815) of from 3 to 30% and a boil shrinkage (as defined in German Standard Specification DIN 53 866) of less than 10%.

The sewing yarns according to the present invention have good mechanical properties, such as tensile strength, modulus of elasticity and elongation at break and also low shrinkage, coupled with excellent resistance to acids, alkalis and solvents. Of particular advantage is the high heat resistance which permits high sewing speeds.

Suitable thermoplastics are polyether ketones, preferably high molecular weight polymers having a relative viscosity, measured at 0.5% strength in 96% strength sulfuric acid at 25° C., of more than 1.0, preferably more than 1.3.

Preferred polyether ketones are those having the structural units

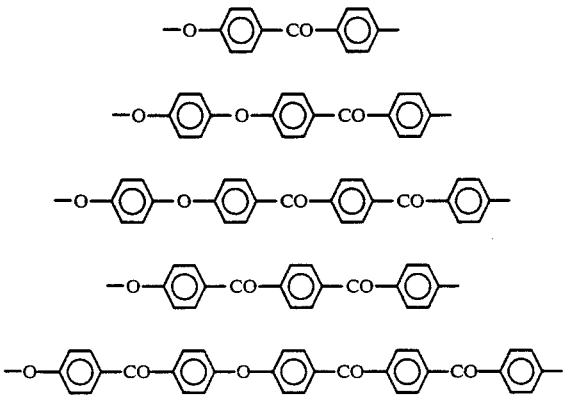

It is also possible to use copolymers where up to 50% of the —CO— groups are replaced by —$SO_2$— groups or the

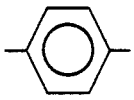

units by

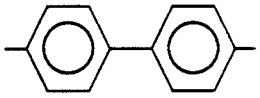

units.

It has been found that to produce sewing yarns it is particularly advantageous to use those multifilament yarns which have an individual filament linear density (as defined in German Standard Specification DIN 53 830) of from 1.0 to 10 dtex, in particular from 1.5 to 6 dtex, and an elongation at break (as defined in German Standard Specification DIN 53 815) of from 3 to 30%, in particular from 5 to 20%. The tensile strength of the yarns (as defined in German Standard Specification DIN 53 815) should preferably be within the range from 4 to 10 cN/dtex. Their shrinkage, measured in boiling water in accordance with German Standard Specification DIN 53 866, should be less than 10%, preferably less than 2%. Their heat shrinkage at 180° C. should preferably be less than 20%, in particular less than 8%.

The multifilament yarns preferably comprise from 10 to 1000, in particular from 20 to 300, individual filaments. The multifilament yarns are preferably drawn immediately after the spinning process, the draw ratio advantageously being within the range from 1.5 to 5. However, the multifilament yarns can also be brought directly to the required high strengths and low elongation at break values in a high-speed spinning process employing high takeup speeds.

The sewing yarns according to the present invention are produced from these multifilament yarns in a conventional manner by twisting. If only one, single-twist multifilament yarn is to be used, the twist factor (as defined in German Standard Specification DIN 53 832) should be within the range $\alpha = 30–100$, preferably $\alpha = 40–80$, in the Z direction. According to DIN 53 832, a twist in the clockwise direction is designated as S direction twist, whereas a twist in the counterclockwise direction is designated as Z direction twist. The symbol S/Z represents the twist directions of a sewing yarn consisting of several multifilamentary yarns. The direction of twist of the preliminary multifilament yarn is in the S direction and the direction of twist of the folding is in the Z direction. In principle, even such a single-twist multifilament yarn may be used as sewing yarn. Preferably, however, at least 2, preferably 2–4, multifilament yarns are twisted together as a sewing yarn, in which case the twist factor for the preliminary twist should be $\alpha_{pre} = 60–110$ and the twist factor for the folding twist in the opposite direction to the preliminary twist should be $\alpha_{fold} = 80–120$. The preferred combination of twist directions for the preliminary and folding twists is S/Z. The ratio of $\alpha_{pre}$ to $\alpha_{fold}$ here is advantageously chosen in such a way that the ready-produced sewing yarn is balanced and non-snarling.

The twist factor is defined in German Standard Specification DIN 53 832 by the equation $$\alpha = \frac{T/m \sqrt{\text{linear density } [dtex]}}{100},$$

where T/m denotes the number of turns per meter.

The sewing yarns according to the present invention can be finished during spinning with the customary processing finishes, for example lubricants, such as mineral oils, ester oils and alkylene oxide adducts, emulsifiers, such as soaps and ionic or nonionic surfactants, and also antistats such as phosphoric esters of ethoxylated fatty alcohols and ethoxylated fatty acid derivatives. They may subsequently also be finished with paraffins, paraffin waxes or silicone waxes to improve the running properties.

It is a particular advantage of the use of polyether ketone fibers that the sewing yarns can even be processed without heat resistance finish.

EXAMPLES

A. Production of multifilament yarns

1. A polyether ketone with the repeat units (PEKEKK)

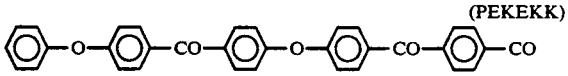

which had a relative solution viscosity of 1.478, measured in a solution of 0.5 g of the polymer in 100 ml of 96% strength $H_2SO_4$ at 25° C., was continuously introduced into a melt spinning apparatus and melted. The melt spinning apparatus was a single-screw extruder comprising 3 electrically heatable heating zones, an electrically heated spinneret of 30 holes each 0.4 mm in diameter, a spinning pump (of the toothed wheel type), an afterheater zone, a drying cell and a takeup means.

The heating zones of the extruder and of the spin pack were set to such a temperature that the melt had a temperature of 415° C. Te output was 1.6 kg/h. The filaments passed through an electrically heated afterheater and then an air-fed drying cell. They were taken off at a takeup speed of 850 m/min and then drawn in a draw ratio of 1:3.0 by heating the intake godet roll of the drawing means to a temperature of 130° C. and the hotplate within the drawing zone to 250° C. The filament yarns had the following properties:

| | |
|---|---|
| Total linear density | 109/30 dtex |
| Filament linear density | 3.6 dtex |
| Tensile strength | 5.4 cN/dtex |
| Elongation at break | 11.4% |
| Boil shrinkage | 0.5% |
| Hot air shrinkage | 3.5% |
| Modulus of elasticity | 45.1 cN/dtex |

2. A polyether ketone with the repeat unit

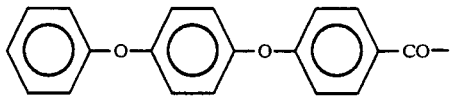

which had a relative solution viscosity of 1.98 was spun in the apparatus described in Example 1. The temperature of the melt was 375° C., the spinneret had 30 holes each 0.3 mm in diameter, and the takeup speed was 700 m/min from an output of 1.2 kg/h. The spun filaments were then hot-drawn in a ratio of 1:2.9 at 160°/210° C. and thereafter had the following properties:

| | |
|---|---|
| Total linear density | 110/30 dtex |
| Filament linear density | 3.7 dtex |
| Tensile strength | 5.9 cN/dtex |
| Elongation at break | 14.0% |
| Modulus of elasticity | 68.0 cN/dtex |
| Boil shrinkage | 2.0% |
| Hot air shrinkage | 5.0% |

B. Production of sewing yarns

A multifilament yarn as per Example A2 was parallel-wound onto flanged bobbins on a high-speed winder. To produce a 3-fold yarn, 3 of these flanged bobbins were creeled in the upper deck of a twist-fold-twist machine and initially provided with a preliminary twist in the S direction. Downstream the 3 highly twisted multifilament yarns were folded and twisted 3-fold in the Z direction by means of a ring spindle. The present Example was performed with 700 turns per meter of S, corresponding to a preliminary twist factor $\alpha_{pre}$ of 76. The subsequent folding twist amounted to 530 turns per meter of 3 Z, corresponding to folding twist factor $\alpha_{fold} = 100$.

The folded filament yarn thus produced was then rewound into dyeing packages on a precision winder. The thermal properties of the polyether ketone made it possible to dye the sewing yarn using the customary dyeing methods, albeit at elevated temperatures within the range from 180° to 200° C.

The thermal properties of the dyed sewing yarn of the present invention are remarkably good owing to the high melting point of polyether ketone of 334° C. and a maximum temperature for sustained exposure of 250° C. It is consequently possible to dispense with a specific sewing yarn finish. However, for reasons of better running properties on passing through the yarn guide elements of the sewing machine and on insertion into the material being sewed, it is advisable to apply an additional finish. This is done by applying silicone-containing waxes or emulsions to the dyed sewing yarn via a lick roll, or other known methods of finishing sewing yarns, for example finishing in the dyeing machine, are employed.

The sewing yarn produced by this process has excellent sewing properties compared with conventional sewing yarn. For instance, a sewing test showed that, compared with polyester filament yarns, the sewing yarn according to the present invention produces twice the seam length until it breaks. The distinctly better thermal and sewing properties are complemented by an excellent hydrolysis resistance and resistance to chemicals, for example hydrochloric acid, sulfuric acid, nitric acid, potassium hydroxide solution and trichloroethylene.

We claim:

1. A sewing yarn comprising at least one multifilament yarn whose twisted individual filaments are made of a thermoplastic polymer, wherein the thermoplastic polymer is a polyether ketone and the multifilament yarn has an individual filament density of from 1.0 to 10 dtex, an elongation at break of from 3 to 30% and a boil shrinkage of less than 10%.

2. A sewing yarn as claimed in claim 1, wherein the polyether ketone has a relative viscosity, measured at 0.5% strength in 96% strength sulfuric acid at 25° C., of more than 1.0.

3. The sewing yarn as claimed in claim 2, wherein said polyether ketone has a relative viscosity of more than 1.3.

4. A sewing yarn as claimed in claim 1, wherein the multifilament yarn comprises from 10 to 1000 individual filaments.

5. A sewing yarn as claimed in claim 4, wherein said multifilament yarn comprises 20–300 individual filaments.

6. A sewing yarn as claimed in claim 1, comprising a single multifilament yarn with a twist factor for the mutually twisted-together individual filaments is within the range $\alpha = 30–100$ in the Z direction.

7. The sewing yarn as claimed in claim 6, wherein $\alpha = 40–80$ in the Z direction.

8. A sewing yarn a claimed in claim 1, comprising at least two multifilament yarns wherein the twist factor for the preliminary twist of the individual multifilament yarns is within the range $\alpha_{pre} = 60–110$ and the twist factor for the folding twist of the mutually twisted-together multifilament yarns is within the range $\alpha_{fold} = -80–120$, and the directions of the preliminary twist and the folded twist are mutually opposite.

9. A sewing yarn as claimed in claim 1, wherein the polyether ketone contains at least 50% of structural units selected from the group consisting of

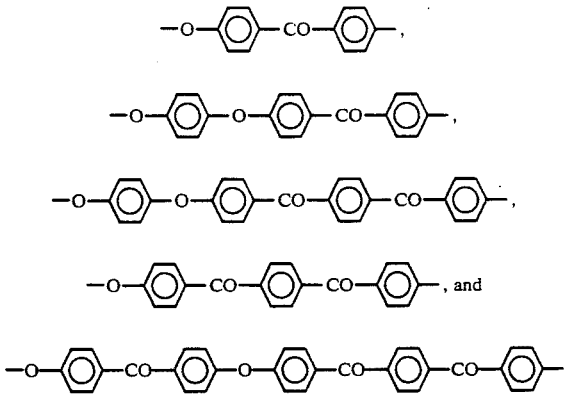

10. The sewing yarn as claimed in claim 1, wherein the individual filament linear density is from 1.5 to 6 dtex.

11. The sewing yarn as claimed in claim 1, wherein the elongation at break is from 5 to 20%.

12. The sewing yarn as claimed in claim 1, having a tensile strength of from 4 to 10 cN/dtex.

13. The sewing yarn as claimed in claim 1, wherein the boil shrinkage is less than 2%.

14. A sewing yarn comprising at least one multifilament yarn whose twisted individual filaments are made of a thermoplastic polymer, wherein the thermoplastic polymer is a polyether ketone and the multifilament yarn has an individual filament linear density of from 1.0 to 10 dtex, an elongation at break of from 3 to 30% and a boil shrinkage of less than 10%, the sewing yarn further comprising one of a lubricant, an emulsifier and an antistatic finishing compound.

15. The sewing yarn as claimed in claim 14, wherein said lubricant is selected from the group consisting of mineral oils, ester oils and alkylene oxide adducts.

16. The sewing yarn as claimed in claim 14, wherein said emulsifier is selected from the group consisting of soaps, ionic surfactants and nonionic surfactants.

17. The sewing yarn as claimed in claim 14, wherein said antistatic finishing compound is selected from the group consisting of phosphoric esters of ethoxylated fatty alcohols and phosphoric esters of ethoxylated fatty acid derivatives.

18. A sewing yarn comprising at least one multifilament yarn whose twisted individual filaments are made of a thermoplastic polymer, wherein the thermoplastic polymer is a polyether ketone and the multifilament yarn has an individual filament linear density of from 1.0 to 10 dtex, an elongation at break of from 3 to 30% and a boil shrinkage of less than 10%, the sewing yarn further comprising a compound selected from the group consisting of paraffins, paraffin waxes and silicone waxes.

* * * * *